US010076172B2

(12) United States Patent
Stephens et al.

(10) Patent No.: US 10,076,172 B2
(45) Date of Patent: Sep. 18, 2018

(54) DIFFUSER

(71) Applicant: Dyson Technology Limited, Wiltshire (GB)

(72) Inventors: Philip Jonathan Stephens, Swindon (GB); Stephen Farrar Smith, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 283 days.

(21) Appl. No.: 15/181,906

(22) Filed: Jun. 14, 2016

(65) Prior Publication Data

US 2016/0367004 A1 Dec. 22, 2016

(30) Foreign Application Priority Data

Jun. 16, 2015 (GB) ..... 1510532.3
Jun. 16, 2015 (GB) ..... 1510542.2

(51) Int. Cl.
*A45D 20/12* (2006.01)

(52) U.S. Cl.
CPC ..... *A45D 20/122* (2013.01)

(58) Field of Classification Search
CPC ..... A45D 20/12; A45D 20/122
USPC ..... 34/96–100
See application file for complete search history.

(56) References Cited

U.S. PATENT DOCUMENTS 4,230,279 A 10/1980 Forsberg
4,287,673 A 9/1981 Wolter
4,295,283 A 10/1981 Tomaro
4,391,047 A 7/1983 Janssens et al.
4,848,007 A 7/1989 Montagnino
5,036,601 A 8/1991 Mulle, Jr. et al.
5,060,398 A 10/1991 Wolens
5,161,317 A 11/1992 McDougall
5,235,759 A 8/1993 Rizzuto, Jr.
5,275,339 A 1/1994 Andis et al.
5,303,483 A 4/1994 Chan
5,392,528 A 2/1995 McDougall
5,467,540 A 11/1995 Bastien
5,488,783 A 2/1996 Parkinson et al.
(Continued)

FOREIGN PATENT DOCUMENTS

CN 2598409 1/2004
CN 201758987 3/2011
(Continued)

OTHER PUBLICATIONS

Search Report dated Nov. 27, 2015, directed to GB Application No. 1510532.3; 1 page.

(Continued)

*Primary Examiner* — Stephen M Gravini
(74) *Attorney, Agent, or Firm* — Morrison & Foerster LLP

(57) ABSTRACT

A diffuser includes a baffle having an air inlet end, an air outlet end and an outwardly tapering wall extending between the air inlet end and the air outlet end, and which defines a diffusing air chamber, and a grille connected to the baffle, the grille including a plurality of air outlets. The air inlet end of the baffle includes an air inlet and a drainage channel, spaced from the air inlet, for receiving water which has entered the air chamber through the air outlets. The drainage channel has drainage holes for draining water away from the air inlet.

13 Claims, 9 Drawing Sheets

(56) References Cited

U.S. PATENT DOCUMENTS

| | | | | |
|---|---|---|---|---|
| 5,621,980 | A | 4/1997 | Kingsbury | |
| 5,715,847 | A | 2/1998 | Rolf et al. | |
| 5,765,292 | A | 6/1998 | Chan | |
| 5,845,656 | A | 12/1998 | Assmann | |
| 6,089,239 | A | 7/2000 | Ehlhardt et al. | |
| 9,936,788 | B2 * | 4/2018 | Stephens | A45D 20/122 |
| 9,936,789 | B2 * | 4/2018 | Stephens | A45D 20/122 |
| 2003/0084586 | A1 | 5/2003 | Lo | |
| 2003/0159306 | A1 | 8/2003 | Yeung | |
| 2004/0047620 | A1 | 3/2004 | Ruben | |
| 2004/0163274 | A1 | 8/2004 | Andrew et al. | |
| 2005/0193584 | A1 | 9/2005 | McCambridge et al. | |
| 2005/0257395 | A1 | 11/2005 | Keong | |
| 2007/0137060 | A1 | 6/2007 | Woodson | |
| 2008/0271337 | A1 | 11/2008 | Chan | |
| 2009/0100698 | A1 | 4/2009 | Primm | |
| 2011/0209721 | A1 | 9/2011 | Yahnker et al. | |
| 2013/0174439 | A1 | 7/2013 | Ragosta et al. | |
| 2016/0367004 | A1 * | 12/2016 | Stephens | A45D 20/122 |
| 2016/0367005 | A1 * | 12/2016 | Stephens | A45D 20/122 |
| 2016/0367006 | A1 * | 12/2016 | Stephens | A45D 20/122 |
| 2016/0367008 | A1 * | 12/2016 | Stephens | A45D 20/122 |

FOREIGN PATENT DOCUMENTS

| | | | |
|---|---|---|---|
| DE | 27 28 406 | 1/1979 | |
| DE | 90 12 021 | 12/1990 | |
| DE | 295 07 649 | 10/1996 | |
| EP | 0 439 781 | 8/1991 | |
| EP | 0 473 822 | 3/1992 | |
| EP | 0 784 947 | 7/1997 | |
| EP | 0 940 101 | 9/1999 | |
| EP | 1 188 392 | 3/2002 | |
| ES | 285680 | 3/1985 | |
| ES | 288203 | 7/1985 | |
| ES | 1 005 578 | 11/1988 | |
| ES | 1019307 | 11/1991 | |
| ES | 1 019 362 | 3/1992 | |
| ES | 1 078 375 | 1/2013 | |
| FR | 2 446 615 | 8/1980 | |
| FR | 2 725 346 | 4/1996 | |
| GB | 187358 | 10/1922 | |
| GB | 2 259 007 | 3/1993 | |
| GB | 2 374 801 | 10/2002 | |
| GB | 2 413 492 | 11/2005 | |
| GB | 2 414 180 | 11/2005 | |
| JP | 45-18529 | 7/1970 | |
| JP | 57-45802 | 3/1982 | |
| JP | 63-37105 | 3/1988 | |
| JP | 4-77804 | 7/1992 | |
| JP | 6-109 | 1/1994 | |
| JP | 2006-75194 | 3/2006 | |
| RU | 2 127 993 | 3/1999 | |
| WO | WO-92/11783 | 7/1992 | |
| WO | WO-97/09899 | 3/1997 | |
| WO | WO-2006/123096 | 11/2006 | |
| WO | WO-2007/105069 | 9/2007 | |
| WO | WO-2008/027171 | 3/2008 | |
| WO | WO-2010/115309 | 10/2010 | |
| WO | WO-2012/012934 | 2/2012 | |
| WO | WO-2012/093035 | 7/2012 | |
| WO | WO-2015/001306 | 1/2015 | |
| WO | WO 2016203196 A1 * | 12/2016 | A45D 20/122 |

OTHER PUBLICATIONS

Search Report dated Dec. 3, 2015, directed to GB Application No. 1510542.2; 1 page.

International Search Report and Written Opinion dated Aug. 24, 2016, directed to International Application No. PCT/GB2016/051495; 10 pages.

* cited by examiner

DIFFUSER

REFERENCE TO RELATED APPLICATIONS

This application claims the priority of United Kingdom Application No. 1510532.3, filed Jun. 16, 2015, and United Kingdom Application No. 1510542.2, filed Jun. 16, 2015, the entire contents of which are incorporated herein by reference.

FIELD OF THE INVENTION

The present invention relates to a diffuser for a hair dryer.

BACKGROUND OF THE INVENTION

A diffuser is known form of attachment for a hair dryer. The diffuser is attached to the airflow outlet end of the hair dryer, and serves to reduce the velocity of the airflow emitted from the hair dryer before it is incident upon the hair of the user.

A diffuser generally comprises a baffle and a grille connected to the baffle. The baffle has an air inlet end, an air outlet end which is larger than the air inlet end, and a tapering wall which extends between the air inlet end and the air outlet end. The air inlet end comprises an air inlet for receiving the airflow from the hair dryer. The wall of the baffle defines a diffusing air chamber within which the velocity of the airflow decreases as the cross-section of the air chamber increases. The grille is connected to the air outlet end of the diffuser, and provides air outlets from which air is emitted from the diffuser. A set of projections or prongs are generally upstanding from the grille to contact the hair of the user during hair drying. Each of the projections generally has an air outlet for emitting air into the user's hair.

SUMMARY OF THE INVENTION

In a first aspect, the present invention provides a diffuser for attachment to an airflow outlet end of a hair dryer, the diffuser comprising at least one air inlet for receiving an airflow from a hair dryer; an external grille comprising a plurality of air outlets for emitting at least part of the airflow from the diffuser; and an internal grille located between said at least one air inlet and the external grille, the internal grille comprising an array of apertures through which the airflow passes between said at least one air inlet and the air outlets.

Providing an internal grille between the air inlet(s) and the air outlets of the external grille can reduce further the peak velocity at which the air flow is emitted from the diffuser, and can improve the evenness, both by way of distribution and velocity, of the air flow emitted from the air outlets of the external grille.

The internal grille is preferably in the form of a perforated plate located between the air inlet(s) and the air outlets. The internal grille and the external grille preferably have different shapes. The external grille is preferably concave in shape, whereas the internal grille is preferably substantially planar. The apertures in the internal grille preferably have substantially the same size and shape. Each of the apertures in the internal grille is preferably circular in cross-section. The apertures preferably taper inwardly from a first, inlet surface, which faces the air inlet(s), towards a second, outlet surface which faces the external grille. In other words, the apertures are preferably frustoconical in shape, and each have a diameter at the inlet surface which is larger than the diameter at the outlet surface. To reduce noise as air passes through the internal grille, for each aperture the perimeter of the aperture on the outlet surface is preferably sharper than the perimeter of the aperture on the inlet surface. The perimeter of the aperture on the inlet surface is preferably rounded, and has a curvature with a radius in the range from 0.2 to 0.4 mm. The inlet surface and the outlet surface of the internal grille are preferably substantially parallel.

At the outlet surface, the apertures preferably have a diameter which is in the range from 0.25 to 2.5 mm. The internal grille may be formed from a metallic material, in which case the apertures may be formed in the internal grille by an etching process. Alternatively, the internal grille may be formed from a plastics material, in which case the apertures may be formed during molding of the internal grille and have a diameter at the outlet surface which is in the range from 1 to 2 mm.

Within the array, the apertures are preferably evenly distributed. The array preferably covers substantially the entirety of the internal grille.

The diffuser preferably comprises a baffle which defines a diffusing air chamber through which the airflow passes from the air inlet(s) to the air outlets. The internal grille is located within the air chamber.

The air inlet(s) is preferably defined by the baffle. The baffle preferably comprises an air inlet end and an air outlet end, with the air outlet end being larger than the air inlet end. An outwardly tapering wall, in other words, a wall which tapers outwardly in a direction extending towards the air outlet end of the baffle, extends between the air inlet end and the air outlet end of the baffle.

The air inlet(s) is preferably located at the air inlet end of the baffle. The external grille is preferably connected to the air outlet end of the baffle. The internal grille is preferably spaced from both the air inlet(s) and the external grille. In a preferred embodiment, the internal grille is located generally midway between the air inlet end and the air outlet end of the baffle. For example, the perimeter of the internal grille may be supported by a ledge formed on the internal surface of the wall of the baffle. The internal grille preferably has a generally circular perimeter to inhibit the leakage of air from between the perimeter of the internal grille and the internal surface of the wall of the baffle.

The internal surface of the external grille preferably comprises a first connector and the baffle preferably comprises a second connector which connects to the first connector of the external grille. One of the connectors, for example the first connector, preferably comprises a male connector and the other one of the connectors, in this example the second connector, preferably comprises a female connector for receiving the male connector. The connectors are preferably located on the longitudinal axis of the diffuser. The connectors preferably comprise inter-engaging angular alignment members which angularly align the external grille relative to the baffle. The internal grille preferably comprises a central aperture through which the male connector extends so that the internal grille is secured in a fixed position within the air chamber through the connection of the external grille to the baffle.

The air inlet(s) may comprise a single air inlet, or a plurality of air inlets. For example, the diffuser may comprise a single air inlet, which is generally centered on the longitudinal axis of the diffuser, for receiving an air flow from a hair dryer. Alternatively, the diffuser may comprise a plurality of air inlets for receiving the air flow. For example, the diffuser may comprise an air inlet end which comprises a grille which defines a plurality of air inlets of the diffuser.

In a preferred embodiment, the air inlet(s) is spaced from the longitudinal axis of the diffuser. The air inlet(s) may comprise at least one slot. In the preferred embodiment the hair dryer comprises a single air inlet in the form of an annular slot. Such a diffuser is suitable for use with the type of hair dryer described in WO2015/001306, the contents of which are incorporated herein by reference, in which a hot air flow is emitted from an annular slot located at the air outlet end of the hair dryer. As an alternative to providing an air inlet in the form of an annular slot, the diffuser may comprise a plurality of curved, slot-shaped air inlets, a plurality of circular air inlets, arranged in a circular pattern in the air inlet end of the diffuser, or a single circular air inlet concentric with the longitudinal axis of the diffuser.

To prevent the airflow from becoming attached to the internal surface of the tapering wall of the baffle as it enters the air chamber, the baffle preferably comprises an annular air channel for receiving the airflow from the air inlet(s). The air channel comprises a first set of outlets arranged to emit a first part of the airflow into the air chamber in a radially inward direction, and a second set of outlets arranged to emit a second part of the airflow into the air chamber in a radially outward direction. The emission of the airflow through the two sets of outlets of the air channel can distribute the airflow relatively evenly throughout the air chamber.

In a second aspect, the present invention provides a diffuser for attachment to an airflow outlet end of a hair dryer, the diffuser comprising a baffle comprising an air inlet end, an air outlet end and an outwardly tapering wall extending between the air inlet end and the air outlet end, and which defines a diffusing air chamber; and a grille connected to the baffle, the grille comprising a plurality of air outlets; wherein the baffle comprises at least one air inlet located at the air inlet end and spaced from the longitudinal axis of the diffuser, and an annular air channel for receiving an airflow from said at least one air inlet, the air channel comprising a first set of outlets arranged to emit a first part of the airflow into the air chamber in a radially inward direction, and a second set of outlets arranged to emit a second part of the airflow into the air chamber in a radially outward direction.

The air channel is preferably delimited, at least in part, by an annular inner channel wall upstanding from the air inlet end, and an annular outer channel wall upstanding from the air inlet end. An annular end wall may be connected to the ends of the channel walls. The first set of outlets is preferably formed in the inner channel wall. The second set of outlets is preferably formed in the outer channel wall.

Within each set of outlets, the number of outlets is preferably in the range from four to ten. The sets of outlets preferably comprise the same number of outlets. The first set of outlets is preferably arranged in a first angular array, and the second set of outlets is preferably arranged in a second angular array. Within each array, the outlets are preferably equally angularly spaced. The second angular array is preferably angularly offset relative to the first angular array so that the outlets of the first angular array do not overlap with the outlets of the second angular array.

The baffle preferably comprises a projection upstanding from the air inlet end. The projection preferably comprises the second connector. The projection is preferably substantially conical or frustoconical in shape, so as to taper inwardly in a direction extending towards the air outlet end. The first set of outlets surrounds the projection, so that as air is emitted from the first set of outlets, that air is guided by the projection towards a central portion of the air outlet end of the baffle.

Thus, the first set of outlets is preferably arranged to emit a first part of the airflow from the air channel towards the projection, and the second set of outlets is preferably arranged to emit a second part of the airflow from the air channel towards the outwardly tapering wall of the baffle.

In a third aspect, the present invention provides a diffuser for attachment to an airflow outlet end of a hair dryer, the diffuser comprising a baffle comprising an air inlet end, an air outlet end, a conical or frustoconical projection upstanding from the air inlet end and tapering inwardly in a direction extending towards the air outlet end, and an outwardly tapering wall extending between the air inlet end and the air outlet end, and surrounding the projection; and a grille connected to the baffle, the grille comprising a plurality of air outlets; wherein the baffle comprises at least one air inlet located at the air inlet end and spaced from the longitudinal axis of the diffuser, and an annular air channel, located between the projection and the outwardly tapering wall, for receiving an airflow from said at least one air inlet, the air channel comprising a first set of outlets arranged to emit a first part of the airflow from the air channel towards the projection, and a second set of outlets arranged to emit a second part of the airflow from the air channel towards the outwardly tapering wall.

The air outlets may cover substantially the entirety of the external surface of the external grille. However, in a preferred embodiment, the external grille comprises a plurality of regions. Of these regions, preferably a first region comprises a first set of air outlets, a second region comprises a second set of air outlets, and a third region, located between the first region and the second region, is substantially devoid of air outlets. The first region is preferably a central region of the grille, and the second region is preferably a peripheral region of the grille. One or more regions which are substantially devoid of air outlets are preferably located between the peripheral region of the grille and the central region of the grille. For example, the grille may comprise an annular region, devoid of air outlets, which is located between the central region and the peripheral region of the external grille. Alternatively, the grille may comprise a plurality of regions, each devoid of air outlets, which is located between the central region and the peripheral region of the external grille. Such a plurality of regions may be angularly spaced about the central region, with air outlets being located between adjacent ones of that plurality of regions.

Separating the external grille into regions having air inlets, and one or more regions without air outlets, can further enhance the evenness with which air is emitted from the external grille of the diffuser, and can reduce the peak velocity of the air flow emitted from the diffuser. In a fourth aspect, the present invention provides a diffuser for attachment to an airflow outlet end of a hair dryer, the diffuser comprising at least one air inlet for receiving an airflow from a hair dryer; and a grille comprising a plurality of air outlets for emitting at least part of the airflow, each of the air outlets having substantially the same shape, the plurality of air outlets comprising a first set of air outlets located in a first region of the grille, and a second set of air outlets located in a second region of the grille, the grille comprising at least one third region, located between the first region and the second region, which is substantially devoid of said air outlets.

The external grille may comprise a plurality of third regions which are substantially devoid of these air outlets. The third region, or third regions, preferably occupies at least 5% of the surface area of the external surface of the external grille, more preferably at least 10%, and preferably between 10 and 40% of the surface area of the external surface of the external grille. For example, where the third region comprises an annular region which is located between the first and second regions of the external grille, this annular region preferably occupies between 10 and 40%, more preferably between 15 and 35%, of the surface area of the external surface of the external grille.

The first set of air outlets may be arranged in a circular array which is located centrally on the external grille. In a preferred embodiment, the first set of air outlets is arranged in a first annular array, and the second set of air outlets is arranged in a second annular array which extends around the first annular array. Each of the annular arrays has a width extending in a radial direction, and the width of the second annular array is preferably greater than the width of the first annular array. The radial distance between the first annular array and the second annular array may be in the range from 5 to 25 mm.

The external grille may be formed from metallic material, in which case the air outlets may be formed by etching. Alternatively, the external grille may be formed from plastics material. The air outlets are preferably arranged in relatively dense arrays formed in the external grille. Each of the plurality of air outlets is preferably spaced from its neighboring air outlets by a distance in the range from 0.5 to 2 mm, and in a preferred embodiment by a distance in the range from 1.5 to 1.6 mm.

Each of the air outlets extends from an internal surface of the external grille to an external surface of the external grille. To reduce noise as air passes through the air outlets of the grille, for each air outlet the perimeter of the air outlet on the external surface of the grille is sharper than the perimeter of the air outlet on the internal surface of the grille. The perimeter of the air outlet on the internal surface is preferably rounded, and has a curvature with a radius in the range from 0.2 to 0.4 mm.

Each of the air outlets of the external grille is preferably circular in cross-section. The air outlets preferably taper inwardly from the internal surface of the external grille to the external surface of the external grille. In other words, the apertures are preferably frustoconical in shape, and each have a diameter at the internal surface which is larger than the diameter at the external surface. At least a majority of the air outlets, and preferably all of the air outlets, preferably have substantially the same shape which, at the external surface, has a diameter in the range from 0.5 to 2.5 mm, more preferably in the range from 1.25 to 1.75 mm. Providing apertures having a size in this range can encourage a water droplet falling on the external grille, for example during the drying of wet hair, to form a meniscus within an air outlet, with the droplet becoming retained within the air outlet by surface tension at the meniscus. In turn, this encourages the accumulation of water on the external surface of the external grille, as opposed to the water just passing through the air outlets to enter the air chamber.

In a fifth aspect, the present invention provides a diffuser for attachment to an airflow outlet end of a hair dryer, the diffuser comprising at least one air inlet for receiving an airflow from a hair dryer; and a grille comprising a plurality of air outlets for emitting at least part of the airflow from the diffuser, each of the air outlets extending from an internal surface of the grille to an external surface of the grille; wherein at least a majority of the air outlets have substantially the same shape which, at the external surface of the grille, has a diameter in the range from 0.5 to 2.5 mm.

The diffuser preferably comprises a plurality of projections, or prongs, upstanding from the external grille for contacting the hair of a user. Some of the projections are preferably located in a third region of the grille which is located between the first and second arrays of air outlets, whereas other projections are preferably located within the second region of the grille, amongst the air outlets of that region.

Each of the projections preferably comprises an air inlet, an air outlet spaced from the air outlets of the grille, and a bore extending between the air inlet and the air outlet. Thus, a first part of the airflow which enters the diffuser through the air inlet(s) is emitted from the air outlets of the grille, whereas a second part of the airflow is emitted from the air outlets of the projections. Each part of the airflow emitted from the diffuser does not necessarily correspond to a respective part of the airflow which is emitted from the air channel of the baffle.

The longitudinal axes of the bores of the projections are preferably parallel to the longitudinal axis of the diffuser. The air inlet of each projection is located in the internal surface of the external grille, and preferably has a size which is larger than that of each of the plurality of air outlets of the grille. For example, each projection preferably has an air inlet which is circular in shape, and has a diameter which is in the range from 3 to 15 mm.

The air outlet of each projection is preferably located in an end portion of the projection which is remote from the external grille. The air outlet is preferably located on a side surface of the projection so that each projection emits a respective part of the airflow in a direction which is angled to the longitudinal axis of the diffuser. Each projection preferably has an air outlet which has a size, at the external surface of the grille, which is larger than that of each of the plurality of air outlets of the grille. Each projection has a tip which is remote from the external grille and a length extending in a direction extending from the external grille to the tip. The air outlet of the projection preferably has a length which is at least one third of the length of the projection, and more preferably at least one half of the length of the projection. Each air outlet of the projections preferably has a generally elongate shape; in other words, the length of the air outlet is greater than the width of the air outlet.

To reduce the time required to dry hair using the diffuser, the air outlets of the projections are arranged to emit air in various different directions. In a preferred embodiment, the projections are divided into a first set of projections and a second set of projections arranged about the first set of projections. The air outlets of the first set of projections are preferably arranged to emit air towards the second set of projections, and the air outlets of the second set of projections face are preferably arranged to emit air towards the first set of projections.

In a sixth aspect, the present invention provides a diffuser for attachment to an airflow outlet end of a hair dryer, the diffuser comprising at least one air inlet for receiving an airflow from a hair dryer; a grille comprising a plurality of air outlets for emitting a first part of the airflow from the diffuser; and a plurality of projections upstanding from the grille for contacting the hair of a user and for emitting a second part of the airflow, each of the projections comprising a respective air outlet located in an end portion of the projection which is remote from the grille; wherein the plurality of projections comprises a first set of projections and a second set of projections arranged about the first set of projections, and wherein the air outlets of the first set of projections are arranged to emit air towards the second set of projections, and the air outlets of the second set of projections face are arranged to emit air towards the first set of projections.

The first set of projections is preferably arranged in a first annular array. As mentioned above, that set of projections is preferably upstanding from a region of the external grille which is substantially devoid of air outlets. The second set of projections is preferably arranged in a second annular array extending about the first annular array. As mentioned above, that second set of projections is preferably upstanding from a peripheral portion of the grille in which the second array of air outlets is disposed. The annular arrays are preferably concentric, and are preferably centered on the longitudinal axis of the diffuser. Within each annular array, the projections are preferably equally angularly spaced.

The air outlets of each of the first set of projections are preferably arranged to emit air in a respective radially outward direction, that is, in a respective direction which extends away from the longitudinal axis of the diffuser. Conversely, the air outlets of each of the second set of projections are preferably arranged to emit air in a respective radially inward direction, that is, in a respective direction which extends towards the longitudinal axis of the diffuser.

Each of the first set of projections is preferably arranged to emit air towards a respective one of the second set of projections. The number of projections in the second set of projections is preferably greater than the number of projections in the first set of projections. In a preferred embodiment, the second set of projections contains twice the number of projections as the first set of projections. Within the second set of projections, alternate projections are preferably arranged to emit air towards a respective one of the first set of projections.

In the event that water does enter the air chamber during use of the diffuser, for example through the air outlets of the projections, then it is desirable to prevent water from passing through the air inlet(s) of the diffuser to heating elements located in a hair dryer to which the diffuser is attached. The air inlet end of the baffle preferably comprises a drainage channel, which is spaced from the air inlet(s), for receiving water which has entered the air chamber through the air outlets. The drainage channel preferably comprises at least one drainage hole, preferably a plurality of drainage holes, for draining water away from the air inlet(s).

In a seventh aspect, the present invention provides a diffuser for attachment to an airflow outlet end of a hair dryer, the diffuser comprising a baffle comprising an air inlet end, an air outlet end and an outwardly tapering wall extending between the air inlet end and the air outlet end, and which defines a diffusing air chamber; and a grille connected to the baffle, the grille comprising a plurality of air outlets; wherein the air inlet end of the baffle comprises at least one air inlet and a drainage channel, spaced from said at least one air inlet, for receiving water which has entered the air chamber through the air outlets, the drainage channel comprising at least one drainage hole for draining water away from said at least one air inlet.

The drainage channel is preferably annular in shape so as to surround the air inlet(s) of the baffle. The drainage channel is preferably positioned adjacent to the outwardly tapering wall of the baffle to receive water which has run along the internal surface of the wall towards the air inlet end of the baffle. The drainage channel preferably comprises a plurality of drainage holes, and these drainage holes are preferably evenly, or equally angularly, spaced about the longitudinal axis of the diffuser.

The drainage holes may be arranged to drain water directly on to an external surface of the diffuser. In a preferred embodiment, the diffuser comprises an external wall which surrounds the baffle. The drainage holes are preferably arranged to drain water into a second, preferably annular, air chamber located between the external wall and the baffle, so that the drainage holes are not directly exposed to the external environment. This can reduce the risk of the drainage holes becoming blocked during use of the diffuser. The diffuser preferably comprises an aperture or port in the external wall, or between the external wall and the baffle, from which water may be drained from the second air chamber. This second air chamber is preferably annular. The second air chamber may be divided into the number of sections by ribs or other members extending between the external wall and the wall of the baffle.

As mentioned above, the internal surface of the tapering wall of the baffle may be shaped or otherwise arranged to guide water into the drainage channel. The drainage channel is preferably located between the tapering wall of the baffle and the outer channel wall of the air channel for receiving air from the air inlet(s). This channel wall of the air channel is preferably also shaped to guide water incident thereon towards the drainage channel. For example, the channel wall may be inclined, relative to the longitudinal axis of the diffuser, towards the drainage channel.

The air channel may extend about a second drainage channel. This second drainage channel comprises at least one second drainage hole, preferably a plurality of second drainage holes, for draining water away from the air inlet(s). This second drainage channel is preferably located between the inner channel wall and the central conical or frustoconical projection of the baffle. This inner channel wall is preferably shaped to guide water incident thereon towards the second drainage channel. For example, the inner channel wall may be inclined, relative to the longitudinal axis of the diffuser, towards the second drainage channel. When the diffuser is used in combination with a hair dryer of the type described in WO2015/001306, in which the hot air outlet of the hair dryer extends about an annular bore, the second drainage holes may drain water into the bore of the hair dryer, and thus away from the hot air outlet of the hair dryer.

As mentioned above, the diffuser preferably comprises an external wall which defines, with the baffle, a second air chamber which surrounds the diffusing air chamber of the diffuser. As hot air passes through the diffusing air chamber during use of the diffuser, the temperature of the air within the second air chamber will increase, and so expand. To allow air to leave the second air chamber during use of the diffuser, and to allow ambient air subsequently to enter the second air chamber as the diffuser cools down following use, the second air chamber preferably comprises a plurality of ports in fluid communication with the ambient atmosphere.

In an eighth aspect, the present invention provides a diffuser for attachment to an airflow outlet end of a hair dryer, the diffuser comprising at least one air inlet for receiving an airflow from a hair dryer; a grille comprising a plurality of air outlets for emitting at least part of the airflow from the diffuser; a baffle comprising an outwardly tapering wall which defines a diffusing air chamber through which the airflow passes between said at least one air inlet and the air outlets; and an external wall which surrounds the wall of the baffle to define a second air chamber therebetween, the second air chamber comprising a plurality of ports in fluid communication with the ambient atmosphere.

Each of the ports is preferably in the form of a slot. Each slot may be curved, and in a preferred embodiment each slot is annular in shape. Each of the ports is preferably located proximate to a respective end of the external wall. As mentioned above, one of the ports is preferably located between the external wall, preferably an end of the external wall, and the baffle. The external wall preferably also surrounds the external grille of the diffuser, and another one of the ports is preferably located between the external wall, preferably the other end of the external wall, and the external grille.

Preferably, the external wall is generally frustoconical in shape. To space the external wall from the tapering wall of the baffle, and so allow air to pass through the ports, one of the baffle and the external wall preferably comprises a plurality of spacers for engaging the other one of the baffle and the external wall. The spacers are preferably angularly spaced about the longitudinal axis of the diffuser to provide a number of locations, between adjacent spacers, for receiving an angular alignment member disposed on the other one of the baffle and the external wall. In the preferred embodiment, the spacers are located on an internal surface of the external wall, and are preferably integral with the external wall. The spacers are preferably located between the ends of the external wall. During assembly, the external wall is preferably joined to the baffle at the ends of the spacers.

The baffle, the grilles and the external wall are preferably formed from plastics material, for example a glass-filled nylon material. The preferred technique for joining the baffle to the external grille is ultrasonic welding. The external grille is preferably connected to the air outlet end of the baffle, and so the air outlet end of the baffle preferably comprises a plurality of circumferentially spaced weld ribs upstanding therefrom which are welded ultrasonically to the external grille. The external grille preferably comprises an annular shelf to which the ribs are welded. The shelf may be in the form of a flange or rim of the grille, but in a preferred embodiment the shelf is located between the end of the grille and the second array of apertures formed in the grille. The shelf preferably has a planar internal surface for engaging the ribs, and a planar external surface, opposite to the internal surface, upon which the welding tool is located during assembly.

In a ninth aspect, the present invention provides a diffuser for attachment to an airflow outlet end of a hair dryer, the diffuser comprising a plastics baffle comprising an air inlet end, an air outlet end and an outwardly tapering wall extending between the air inlet end and the air outlet end, and which defines a diffusing air chamber, the air outlet end comprising a plurality of circumferentially spaced weld ribs upstanding therefrom; and a plastics grille comprising a plurality of air outlets and an annular shelf to which the weld ribs of the baffle are ultrasonically welded.

The external wall preferably also comprises a plurality of angularly spaced weld ribs which are ultrasonically welded to the air outlet end of the baffle, preferably simultaneously with the welding of the external grille to the baffle. The ribs of the external wall are preferably disposed on the spacers located on the internal surface of the external wall. The ribs of the external wall are preferably arranged in a circular pattern having the same diameter and radial length as the circular pattern of the ribs of the baffle, and preferably angularly aligned with the ribs of the baffle.

In a tenth aspect, the present invention provides a method of assembling a diffuser, comprising the steps of providing a plastics baffle comprising an air inlet end, an air outlet end and an outwardly tapering wall extending between the air inlet end and the air outlet end, and which defines a diffusing air chamber, the air outlet end comprising a plurality of circumferentially spaced weld ribs upstanding therefrom and arranged in a circular pattern; providing a plastics grille comprising a plurality of air outlets and an annular shelf; positioning the grille over the air outlet end of the baffle so that the weld ribs engage an internal surface of the shelf; and ultrasonically welding the grille to the baffle In an eleventh aspect, the present invention provides a combination of a diffuser as aforementioned and a hair dryer having an air outlet end comprising at least one air outlet. The air outlet(s) of the hair dryer may be spaced from the centre of the air outlet end of the hair dryer, with the air inlet(s) of the diffuser being arranged to receive an airflow emitted from the air outlet(s) of the hair dryer.

Features described above in connection with the first aspect of the invention are equally applicable to each of the second to eleventh aspects of the invention, and vice versa.

BRIEF DESCRIPTION OF THE DRAWINGS

Preferred features of the present invention will now be described by way of example only with reference to the accompanying drawings, in which.

DETAILED DESCRIPTION OF THE INVENTION

Figure 6:
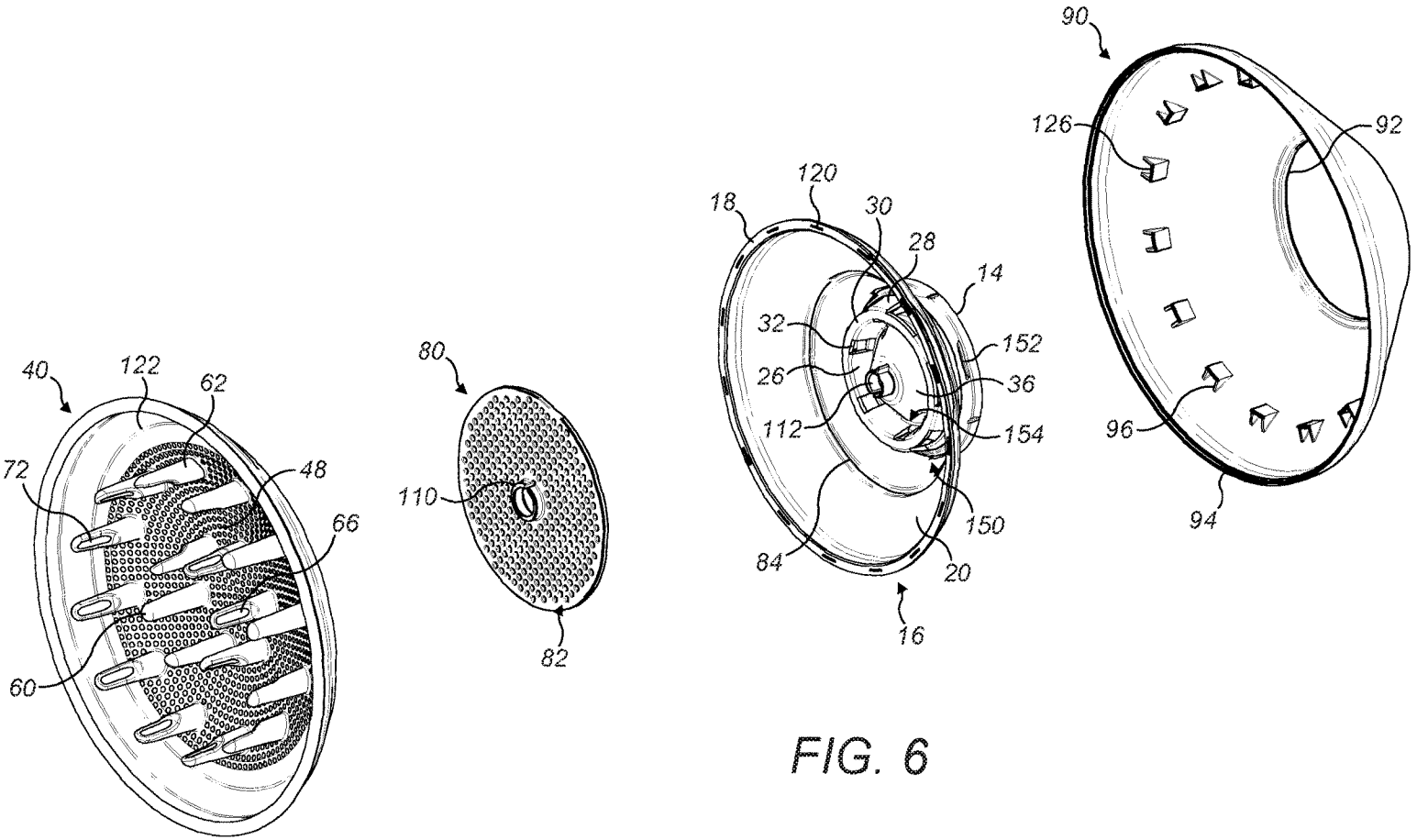
FIG. 6 is a left side, front exploded view of the diffuser.
Figure 7:
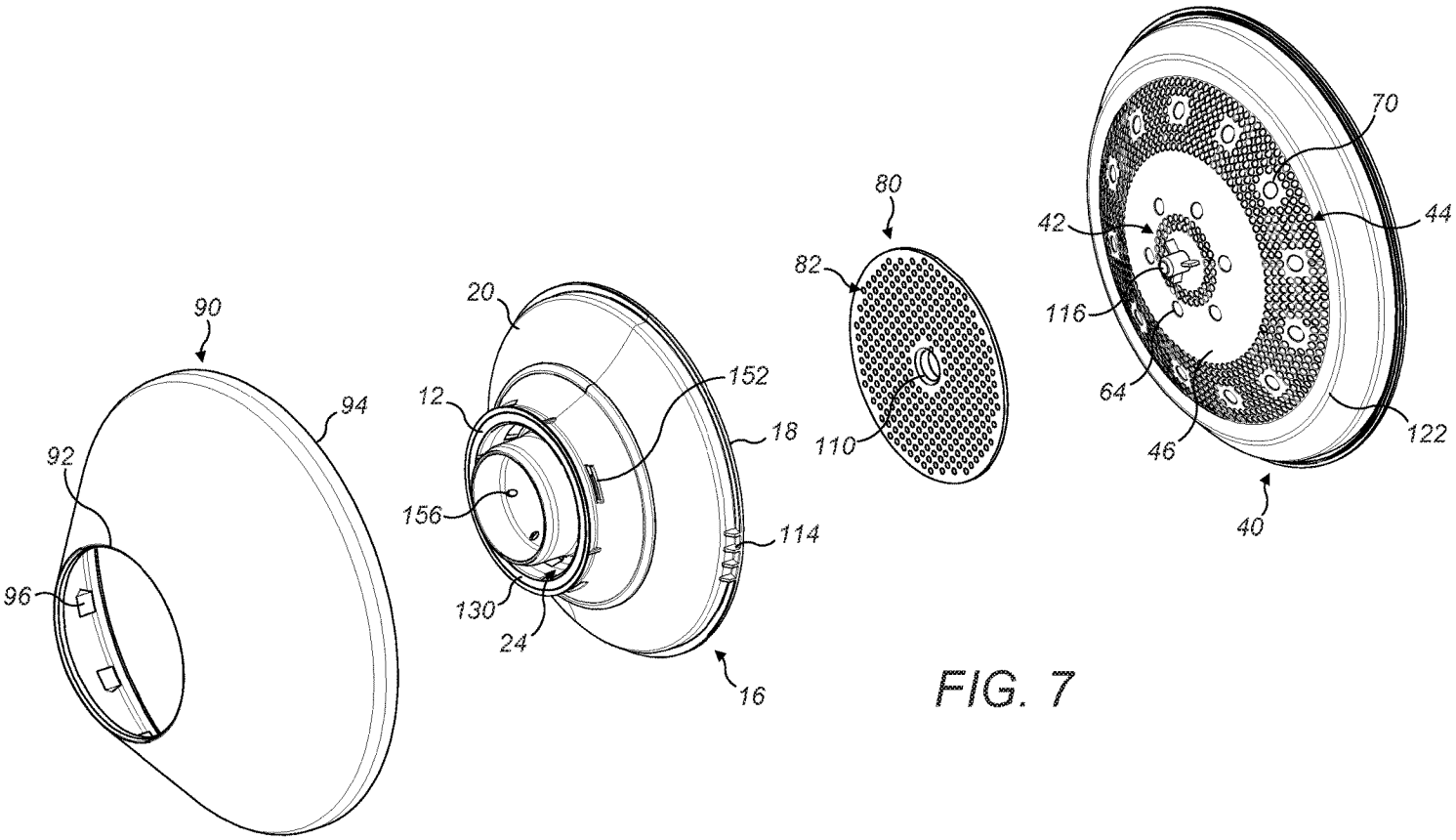
FIG. 7 is a right side, rear exploded view of the diffuser.
Figure 8A:
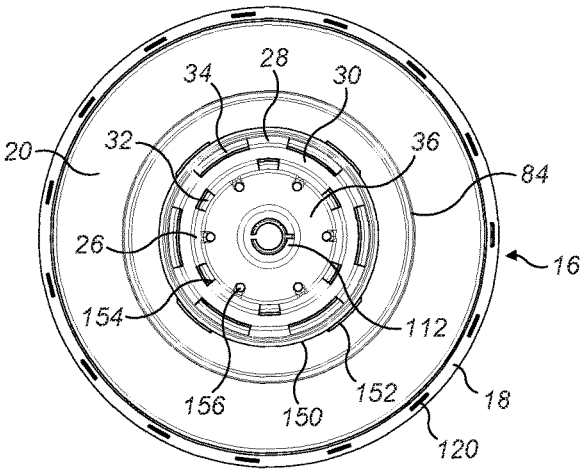
FIG. 8(*a*) is a top view of a baffle of the diffuser, FIG. 8(*b*) is a side view of the baffle, and FIG. 8(*c*) is a bottom view of the baffle.
Figure 8B:
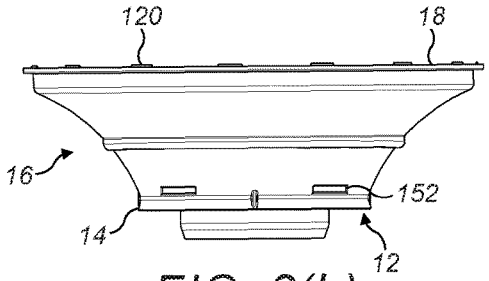
Figure 8C:
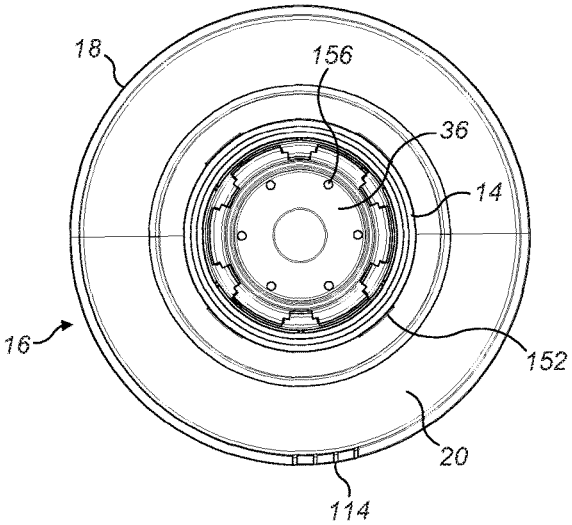
Figure 9A:
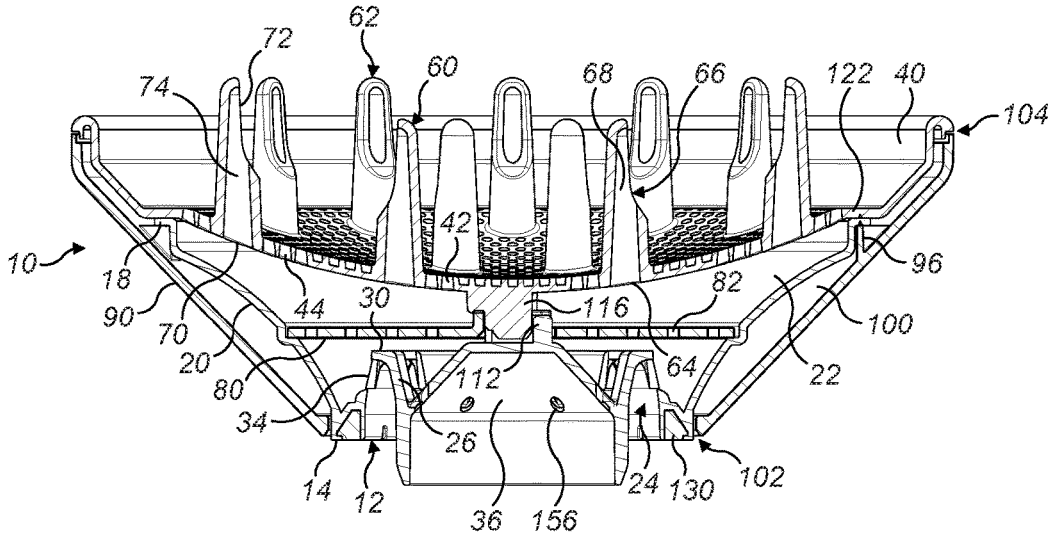
FIG. 9(*a*) is a side sectional view taken along line Y-Y in FIG. 3, FIG. 9(*b*) is a side sectional view taken along line Z-Z in FIG. 3, and FIG. 9(*c*) is a side sectional view taken along line X-X in FIG. 3.
Figure 9B:
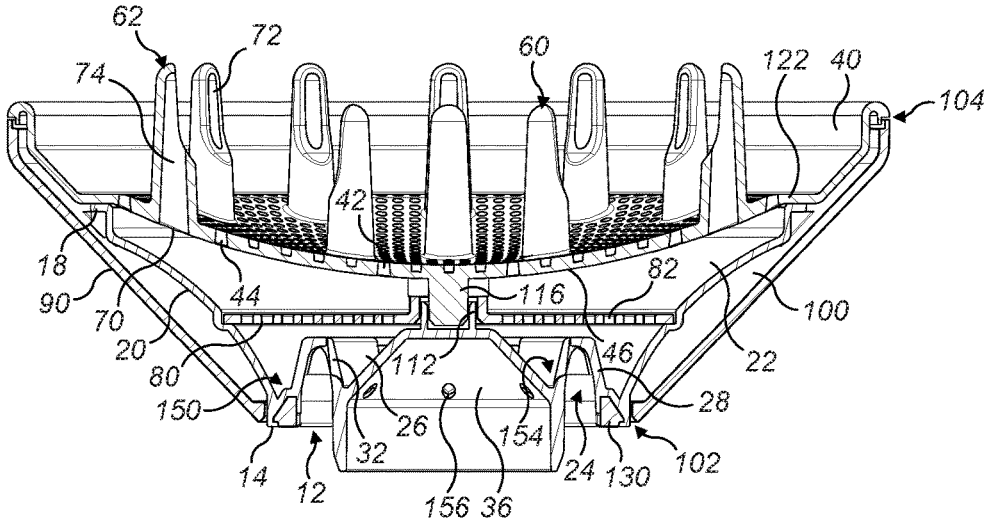
Figure 9C:
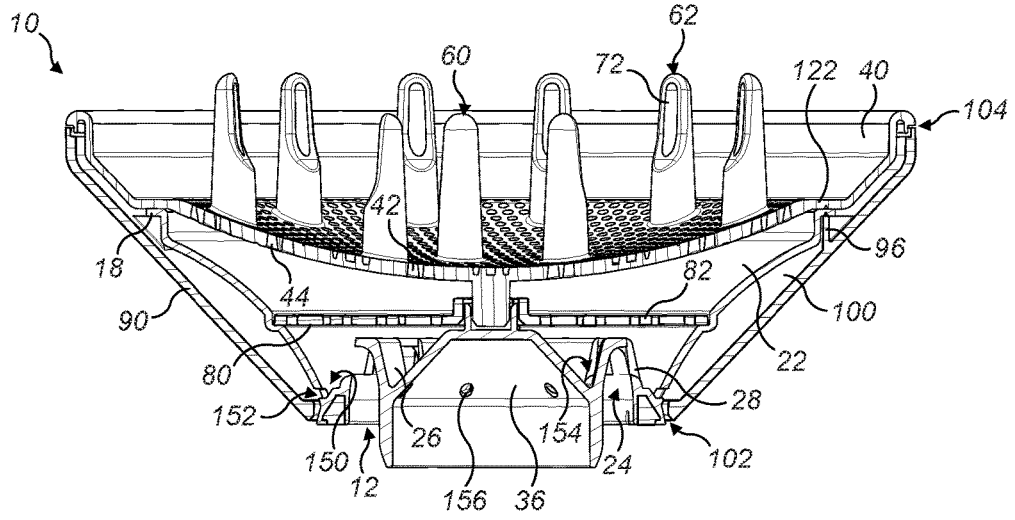

FIGS. 1 to 5 are external views of a diffuser 10. The diffuser 10 comprises an air inlet 12 for receiving an airflow from an airflow outlet end of a hair dryer. With reference also to FIGS. 6 to 8, the air inlet 12 is generally annular in shape, and is in the form of a slot located at the air inlet end 14 of a baffle 16. The baffle 16 has an air outlet end 18 which is larger than the air inlet end 14, and an outwardly tapering wall 20 extending between the air inlet end 14 and the air outlet end 18. As illustrated in FIGS. 9(*a*) to 9(*c*), the tapering wall 20 of the baffle 16 defines a diffusing air chamber 22 through which the airflow passes within the diffuser 10.

The baffle 16 comprises an annular air channel 24 for receiving the airflow from the air inlet 12, and from which the airflow is emitted into the air chamber 22. The air channel 24 is defined by an annular inner wall 26 and an annular outer wall 28 upstanding from the air inlet end 14 of the baffle 16, and an annular end wall 30 which extends between the inner wall 26 and the outer wall 28. The inner wall 26 comprises a first set of air outlets 32 of the air channel 24, and the outer wall 28 comprises a second set of air outlets 34 of the air channel 24. The first set of air outlets 32 is arranged to emit air radially inwardly, towards the longitudinal axis A of the diffuser 10 and towards a frustoconical projection 36 which tapers inwardly towards the longitudinal axis A. The second set of air outlets 34 is arranged to emit air radially outwardly, away from the longitudinal axis A of the diffuser 10 and towards the tapering wall 20 of the baffle 16. Each set of air outlets 32, 34 of the air channel 24 comprises six air outlets which are equally angularly arranged about the longitudinal axis A of the diffuser 10. The first set of air outlets 32 are angularly offset relative to the second set of air outlets 34 so that the first set of air outlets 32 does not overlap radially with the second set of air outlets 34.

An external grille 40 is connected to the air outlet end 18 of the baffle 16. The external grille 40 is generally concave in shape. The external grille 40 comprises air outlets from which a first part of the airflow is emitted from the diffuser 10. These air outlets comprise a first array of air outlets 42 which are located in a central region of the external grille 40, and a second array of air outlets 44 which are located in a peripheral region of the external grille 40 which extends around the first array of air outlets 42. The air outlets 42, 44 have the same size and shape. Each of the air outlets 42, 44 is circular in cross-section. Each of the air outlets 42, 44 may be cylindrical in shape, but in this embodiment each of the air outlets 42, 44 is frustoconical in shape, tapering inwardly from the internal surface of the external grille 40 towards the external surface of the external grille 40. At the external surface, each of the air outlets 42, 44 has a diameter which is in the range from 0.5 to 2.5 mm, and in this embodiment is in the range from 1.5 to 1.6 mm. Each of the air outlets 42, 44 has a perimeter on the external surface of the external grille 40 which is sharper than the perimeter of the air outlet on the internal surface of the external grille 40. The perimeter of the air outlet on the internal surface is preferably rounded, and has a curvature with a radius in the range from 0.2 to 0.4 mm.

Within each array, the air outlets 42, 44 are regularly spaced. The spacing between neighbouring air outlets is in the range from 0.5 to 2 mm, and in this embodiment is also in the range from 1.5 to 1.6 mm.

With particular reference to FIG. 7, the first array of air outlets 42 is arranged in a first annular array which extends around the longitudinal axis A, and which generally receives airflow emitted from the first set of air outlets 32 of the air channel 24. The second array of air outlets 44 is arranged in a second annular array which surrounds, and is concentric with, the first array of air outlets 42. The second set of air outlets 44 generally receives airflow emitted from the second set of air outlets 34 of the air channel 24.

Figure 1:
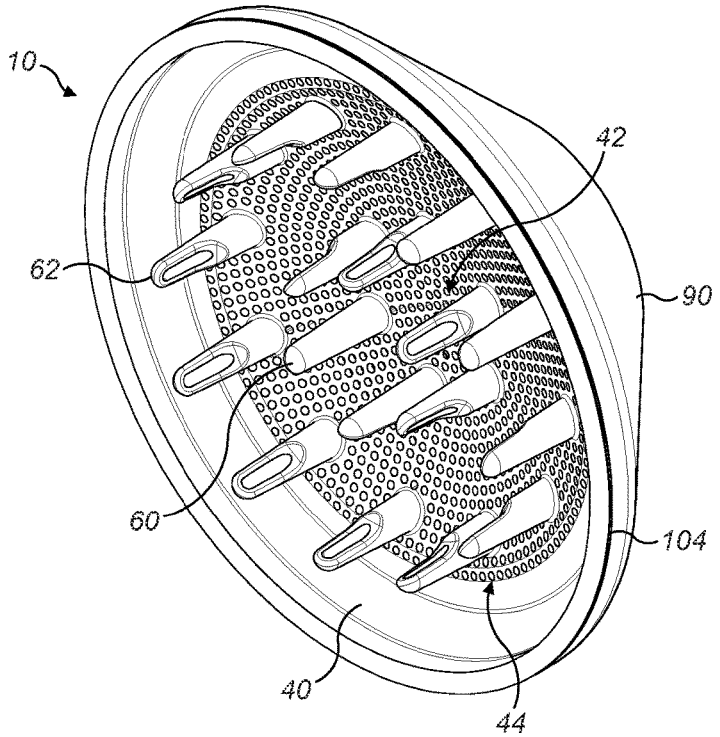
FIG. 1 is a left side, front perspective view, from above, of a diffuser.
Figure 2:
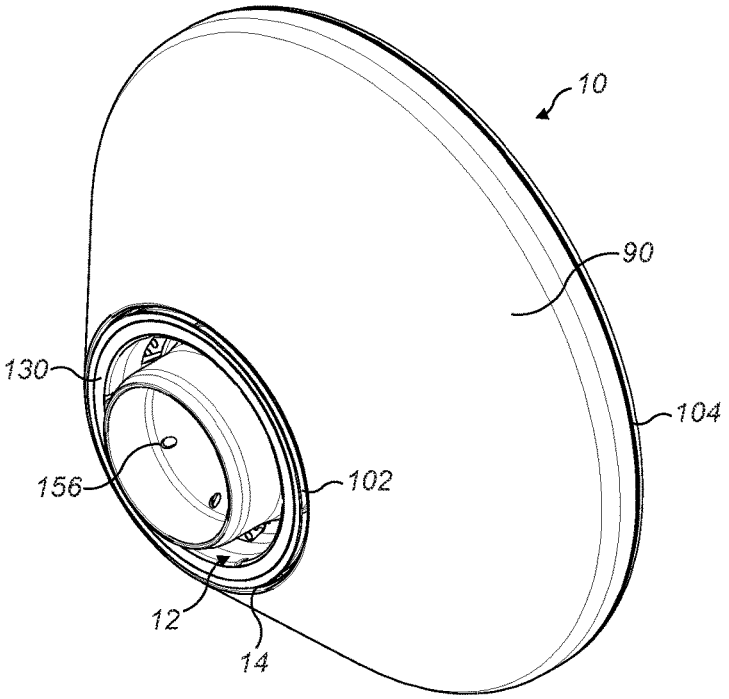
FIG. 2 is a right side, rear perspective, from above, of the diffuser.
Figure 3:
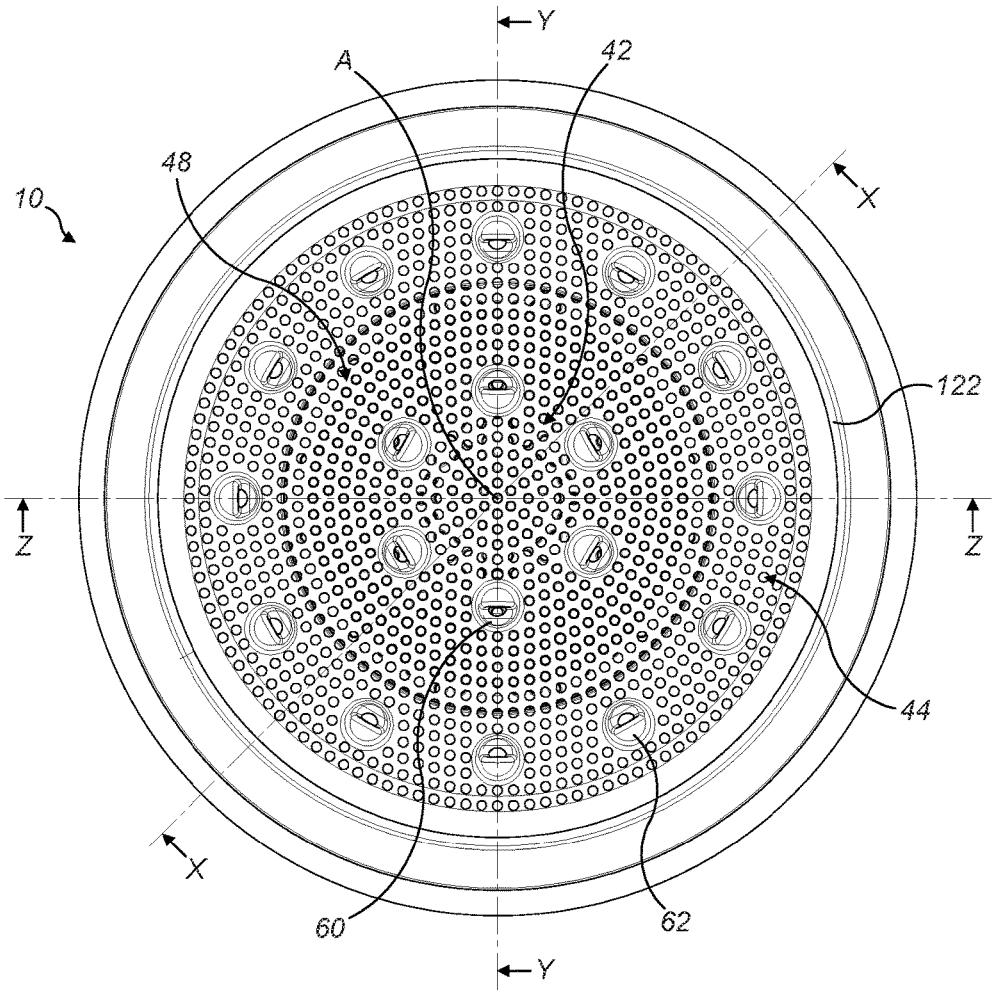
FIG. 3 is a top view of the diffuser.
Figure 4:
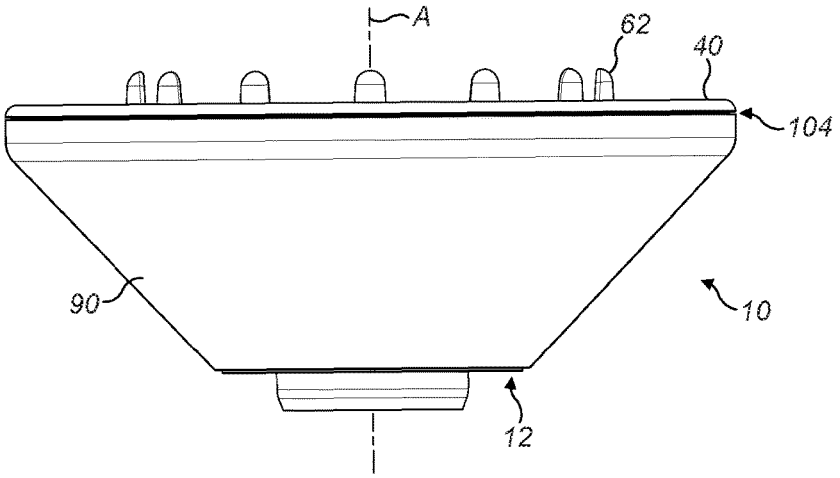
FIG. 4 is a side view of the diffuser.
Figure 5:
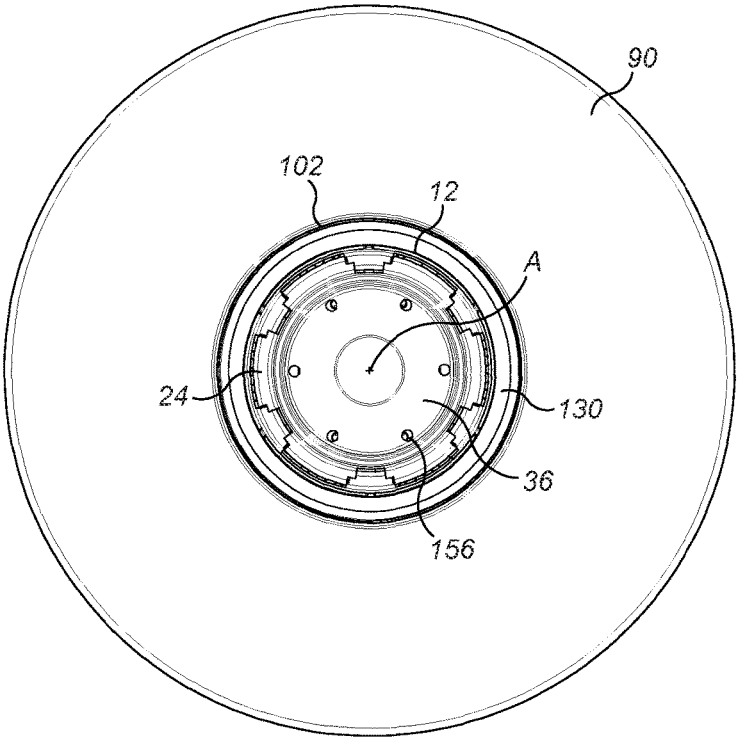
FIG. 5 is a bottom view of the diffuser.

An annular region 46 of the external grille 40, which is located between the arrays of air outlets 42, 44, is substantially devoid of air outlets of the external grille 40. As shown in FIGS. 3 and 6, in this embodiment the external surface of this region 46 of the external grille 40 is formed with an annular array of recesses 48 which have substantially the same size and shape as the air outlets 42, 44 but this is not essential; for example the external surface 48 of this region may be otherwise profiled or generally flat. The size of the annular region 46 is such that it occupies between 10 and 40%, preferably between 15 and 35%, of the surface area of the external surface of the external grille 40, so as to promote an even, diffused emission of air from the diffuser 10.

The diffuser 10 also comprises a plurality of projections for contacting the hair of a user, and for emitting a second part of the airflow from the diffuser 10. The projections are upstanding from the external surface of the external grille 40. In this embodiment, the projections comprise a first set of projections 60 and a second set of projections 62. In this embodiment, the first set of projections 60 have the same size and shape as the second set of projections 62, but alternatively the projections may have different sizes. For example, the first set of projections 60 may be larger than the second set of projections 62.

The first set of projections 60 are arranged in an annular array in the annular region 46 of the external grille 40. In this embodiment, the first set of projections 60 comprises six projections which are equally angularly spaced about the longitudinal axis A. Each of the first set of projections 60 comprises an air inlet 64 formed in the external grille 40, an air outlet 66, and a bore 68 for conveying air from the air inlet 64 to the air outlet 66. The air inlet 64 is circular in shape, and has a diameter which is greater than the diameter of the air outlets 42, 44 of the external grille 40. The air outlet 66 is in the form of an elongate side air outlet, which has a height which is approximately one half of the height of the projection 60, and a width which is smaller than the height. The air outlets 66 of the first set of projections 60 are arranged to emit air radially outwardly, away from the longitudinal axis A of the diffuser 10.

The second set of projections 62 are arranged in an annular array amongst the second array of air outlets 44 of the external grille 40. In this embodiment, the second set of projections 62 comprises twelve projections which are equally angularly spaced about the longitudinal axis A. The second set of projections 62 are arranged such that each of the first set of projections 60 emits air towards a respective one of the second set of projections 62. Similar to the first set of projections 60, each of the second set of projections 62 comprises an air inlet 70 formed in the external grille 40, an air outlet 72, and a bore 74 for conveying air from the air inlet 70 to the air outlet 72. The air outlets 72 of the second set of projections 62 are arranged to emit air radially inwardly, towards the longitudinal axis A of the diffuser 10 so that alternate ones of the second set of projections 62 emit air towards a respective one of the first set of projections 60.

An internal grille 80 is located within the air chamber 22. The internal grille 80 is spaced from both the air inlet 12, and the external grille 40. The internal grille 80 is in the form of a circular disc or plate which comprises an array of apertures 82 through the airflow passes between the air inlet end 14 and the air outlet end 18 of the baffle 16.

The apertures 82 of the internal grille 80 have the same size and shape. The apertures 82 are generally circular in cross-section. The aperture 82 may be cylindrical in shape, but in this embodiment the apertures 82 taper inwardly from a first, inlet surface, which faces the air inlet 12, towards a second, outlet surface which faces the external grille 40. In other words, the apertures 82 are generally frustoconical in shape. At the outlet surface, the apertures 82 have a diameter in the range from 1 to 2 mm. To reduce noise as air passes through the internal grille 80, the perimeter of each aperture 82 on the outlet surface of the internal grille 80 is sharper than the perimeter of the apertures 82 on the inlet surface of the internal grille 80. The perimeters of the apertures 82 on the inlet surface are preferably rounded, and have a curvature with a radius in the range from 0.2 to 0.4 mm.

As shown in FIGS. 9(*a*) to 9(*c*), the periphery of the internal grille 80 is supported by a ledge 84 formed on the internal surface of the tapering wall 20 of the baffle 16. The ledge 84 is located generally midway between the air inlet end 14 and the air outlet end 18 of the baffle 16.

As a hot air flow passes through the diffuser 10, the temperature of the tapering wall 20 of the baffle 16 will rise.

To shield the user from the tapering wall 20 of the baffle 16, the diffuser 10 further comprises an external wall 90 which surrounds the baffle 16 and the external grille 40. The external wall 90 is generally frustoconical in shape, and has a circular first end 92 and a circular second end 94 which is larger than the first end 92. As described in more detail below, the external wall 90 is connected to the air outlet end 18 of the baffle 16. The external wall 90 comprises a plurality of spacers 96 formed on the internal surface of the external wall 90, and which are connected to the baffle 16 during assembly of the diffuser 10. The spacers 96 are arranged in a circular array, and are equally angularly spaced about the longitudinal axis A of the diffuser 10. The spacers 96 serve to space the external wall 90 from the tapering wall 20 of the baffle 16 to define a second, or annular, air chamber 100 therebetween. The diffuser 10 comprises a plurality of ports which place the annular air chamber 100 in fluid communication with the ambient atmosphere. This can allow warm air to be conveyed out from the annular air chamber 100 during use of the diffuser 10, and also allow cool air to enter the annular air chamber 100 following use of the diffuser 10. Each of the ports is in the form of an annular slot located at a respective end of the annular air chamber 100. A first port 102 is located between the first end 92 of the external wall 90 and the air inlet end 14 of the baffle 16. A second port 104 is located between the second end 94 of the external wall 90 and the external grille 40.

Each of the components of the diffuser 10 is formed from a plastics material, in this embodiment glass filled nylon.

To assemble the diffuser 10, the internal grille 80 is first located within the baffle 16 so that the perimeter of the internal grille 80 rests on the ledge 84 of the baffle 16. The internal grille 80 comprises a central aperture 110 is positioned around the perimeter of a female connector 112 located on the end of the frustoconical projection 36 of the baffle 16. The baffle 16 is then located within the external wall 90 so that the air outlet end 18 of the baffle 16 rests on the spacers 96 of the external wall 90. The external surface of the tapering wall 20 of the baffle 16 includes an angular alignment member 114 which is received between an adjacent pair of the spacers 96 to ensure that the baffle 16 is accurately aligned with the external wall 90. The external grille 40 is then positioned on the air outlet end 18 of the baffle 16. The internal surface of the external grille 40 comprises a male connector 116 which is received by the female connector 112 of the baffle 16 as the external grille 40 is positioned on the air outlet end 18 of the baffle 16. The connectors 112, 116 includes inter-engaging alignment members, which in this embodiment are in the form of a slot formed in the perimeter of the female connector 112 for receiving a radial rib formed on the male connector 116, which angularly align the external grille 40 with the baffle 16. This connection of the external grille 40 to the baffle 16 also results in the internal grille 80 becoming sandwiched between the baffle 16 and the external grille 40.

The assembly of the diffuser 10 is completed using ultrasonic welding to secure the external grille 40 to the baffle 16, and to secure the baffle 16 to the external wall 90. A first set of circumferentially spaced weld ribs 120 are upstanding from the air outlet end 18 of the baffle 16. The ribs 120 engage a planar, internal surface of an annular shelf 122 formed on the external grille 40, and which surrounds the air outlets 42, 44 of the external grille 40. A second set of circumferentially spaced weld ribs 126 are upstanding from the spacers 96 of the external wall 90. These ribs 126 engage the underside of the air outlet end 18 of the baffle 16. The ribs 120, 126 are arranged in a similar circular pattern so that each joint 126 is located directly beneath a respective one of the ribs 120. During assembly, an ultrasonic welding tool is positioned on the external surface of the shelf 122 to join the external grille 40 to the baffle 16 at the ribs 120, and simultaneously to join the baffle 16 to the external wall 90 at the ribs 126.

Figure 10:
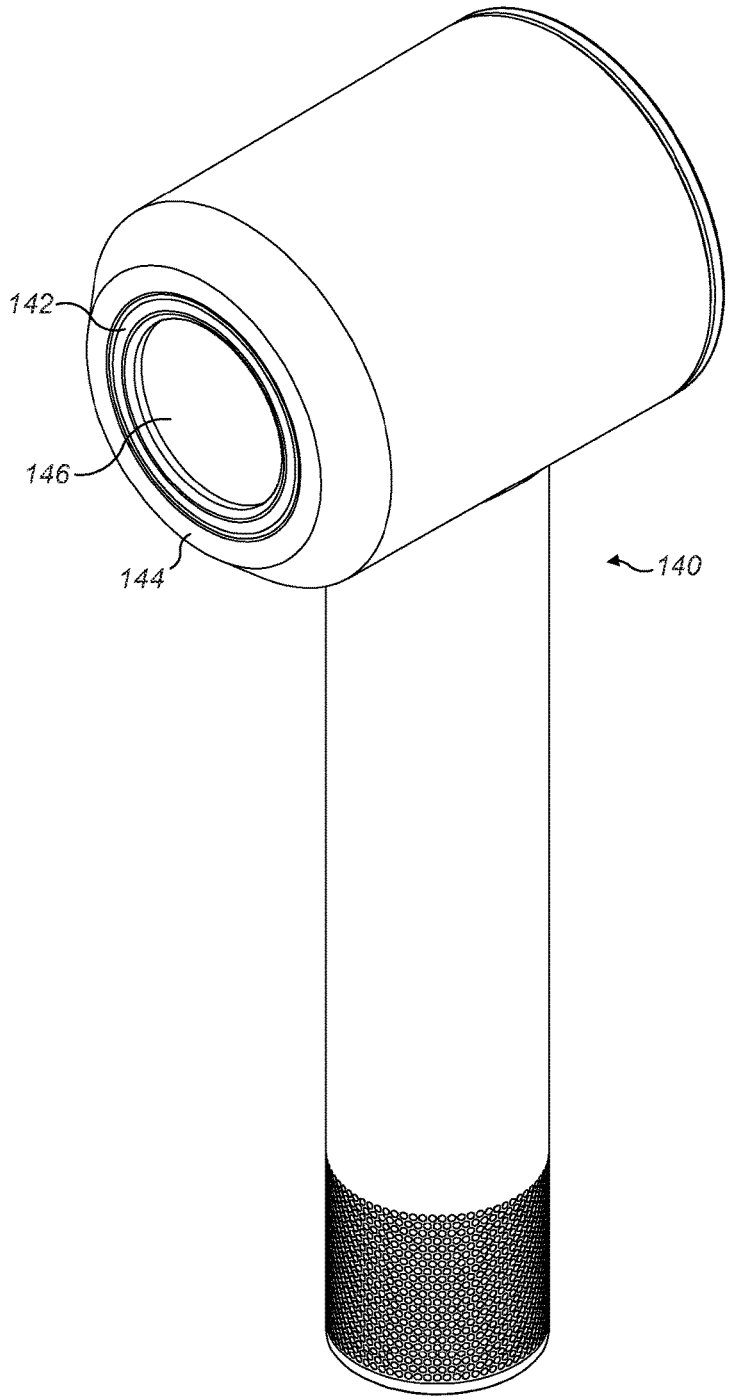
FIG. 10 is a left side, front perspective view, from above, of an example of a hair dryer to which the diffuser may be connected.

In use, the diffuser 10 is attached to the airflow outlet end of a hair dryer. For example, the diffuser 10 may be attached to the hair dryer by a magnet 130 located at the air inlet end 14 of the baffle 16. An example of a hair dryer 140 to which the diffuser 10 may be attached is illustrated in FIG. 10. Such a hair dryer 140 is described in WO2015/001306, the contents of which are incorporated herein by reference, in which a hot airflow is emitted from an annular slot 142 located at the air outlet end 144 of the hair dryer 140. The slot 142 extends around a bore 146 of the hair dryer 140. The airflow passes through the air inlet 12 of the diffuser 10 to enter the air channel 24, and is emitted into the diffusing air chamber 22 through the air outlets 32, 34 of the air channel 24. The airflow passes through the apertures 82 of the internal grille 80 to the internal surface of the external grille 40. A first part of the airflow is emitted from the air outlets 42, 44 of the external grille 40, whereas a second part of the airflow is emitted from the air outlets 66, 72 of the projections 60, 62.

In the event that water enters the air chamber 22 during use of the diffuser 10, for example through the bores 68, 74 of the projections 60, 62, the diffuser 10 comprises drainage holes for draining water from the diffuser 10 and away from the air inlet 12. The baffle 16 comprises a first annular drainage channel 150 which is located between the tapering wall 20 and the outer wall 28 of the air channel 24. The first drainage channel 150 is arranged to receive water droplets which may have passed through the internal grille 80 and run down the internal surface of the tapering wall 20. The outer wall 28 of the air channel 24 is inclined relative to the longitudinal axis A of the diffuser 10 so as to guide water incident thereon towards the first drainage channel 150. The first drainage channel 150 comprises a plurality of drainage holes 152 which are arranged to drain water into the annular air chamber 100, from which water may be expelled through the port 102.

The baffle 16 also comprises a second annular drainage channel 154 which is located between the inner wall 26 of the air channel 24 and the frustoconical projection 36. The second drainage channel 154 is arranged to receive water droplets which may have passed through the internal grille 80 and run down the surface of the projection 36. The inner wall 26 of the air channel 24 is also inclined relative to the longitudinal axis A of the diffuser 10 so as to guide water incident thereon towards the second drainage channel 154. The second drainage channel 154 comprises a plurality of second drainage holes 156 which are arranged to drain water through the projection 36 and, if the diffuser 10 is connected to the hair dryer 140, into the bore 146 of the hair dryer 140. The end wall 30 of the air channel 24 prevent any water for falling directly into the air inlet 12, with any water incident thereon draining on to one of the inner wall 26 and the outer wall 28 of the air channel 24.

The invention claimed is:

1. A diffuser for attachment to an airflow outlet end of a hair dryer, the diffuser comprising:

a baffle comprising an air inlet end, an air outlet end and an outwardly tapering wall extending between the air inlet end and the air outlet end, and which defines a diffusing air chamber; and a grille connected to the baffle, the grille comprising a plurality of air outlets;

wherein the air inlet end of the baffle comprises at least one air inlet and a drainage channel, spaced from the at least one air inlet, for receiving water which has entered the air chamber through the air outlets, the drainage channel comprising at least one drainage hole for draining water away from the at least one air inlet.

2. The diffuser of claim 1, wherein the drainage channel is annular in shape and surrounds the at least one air inlet.

3. The diffuser of claim 1, wherein the drainage channel is arranged to receive water which has run along the internal surface of the outwardly tapering wall towards the air inlet end of the baffle.

4. The diffuser of claim 1, wherein the drainage channel comprises a plurality of drainage holes.

5. The diffuser of claim 4, wherein the drainage holes are equally angularly spaced about the longitudinal axis of the diffuser.

6. The diffuser of claim 1, comprising an external wall surrounding the baffle, wherein the at least one drainage hole is arranged to drain water into a channel located between the external wall and the baffle.

7. The diffuser of claim 1, comprising an air channel for receiving an airflow from the at least one air inlet and for emitting the airflow into the air chamber, the air channel being delimited by at least one wall shaped to guide water incident thereon towards the drainage channel.

8. The diffuser of claim 7, wherein the air channel comprises an annular channel wall upstanding from the air inlet end, the channel wall being inclined relative to the longitudinal axis of the diffuser towards the drainage channel.

9. The diffuser of claim 7, wherein the at least one air inlet is spaced from a longitudinal axis of the diffuser.

10. The diffuser of claim 9, wherein the at least one air inlet comprises at least one slot.

11. The diffuser of claim 10, wherein the at least one air inlet comprises an annular slot.

12. The diffuser of claim 7, wherein the air channel is annular in shape, and extends about a second drainage channel for receiving water which has entered the air chamber through the air outlets, the second drainage channel comprising at least one second drainage hole for draining water away from the at least one air inlet.

13. The diffuser of claim 12, wherein the baffle comprises a conical or frustoconical projection upstanding from the air inlet end for guiding water incident thereon towards the second drainage channel.

* * * * *